US005187873A

United States Patent [19]

Jeng et al.

[11] Patent Number: 5,187,873

[45] Date of Patent: Feb. 23, 1993

[54] STUDENTS MULTI-FUNCTION PROTRACTOR

[76] Inventors: Bill C. B. Jeng, No. 12, Shanhsi E. St., Taichung City, Taiwan; Chiang-Ming Chen, No. 3, Lane 50 Chung Nan, Kuang Hsing Rd., Taiping Hsiang, Taichung Hsien, Taiwan

[21] Appl. No.: 827,348

[22] Filed: Jan. 29, 1992

[51] Int. Cl.[5] ..... B43L 13/08

[52] U.S. Cl. ..... 33/435; 33/26; 33/679; 33/403

[58] Field of Search ..... 33/26, 435, 565, 566, 33/424, 430, 431, 432, 435, 403, 41.1, 438

[56] References Cited

U.S. PATENT DOCUMENTS

| | | | |
|---|---|---|---|
| 224,811 | 2/1880 | Wilson | 33/403 |
| 1,927,992 | 9/1933 | Pulver | 33/679 |
| 2,432,300 | 12/1947 | Ellis | 33/564 |
| 3,548,503 | 12/1970 | Feltenberger | 33/26 |
| 3,925,899 | 12/1975 | Hesse et al. | 33/403 |
| 4,222,171 | 9/1980 | Malacheski | 33/26 |
| 4,791,733 | 12/1988 | Pan et al. | 33/403 |

FOREIGN PATENT DOCUMENTS

| | | | |
|---|---|---|---|
| 0318349 | 6/1934 | Italy | 33/26 |

*Primary Examiner*—William A. Cuchlinski, Jr.
*Assistant Examiner*—William C. Dowling
*Attorney, Agent, or Firm*—Fitch, Even, Tabin & Flannery

[57] ABSTRACT

A protractor including a base having a curved surface formed in an upper portion, a disc including a circular outer peripheral surface for slidable engagement with the curved surface of the base, the disc including an opening, a pair of flanges formed in parallel in the opening, and a slide including two end portions slidably engaged with the flanges of the disc so that the slide can be guided to slide along the flanges, whereby various geometric figures can be drawn by the protractor when the disc rotates relative to the base and when the slide slides along the flanges.

3 Claims, 6 Drawing Sheets

STUDENTS MULTI-FUNCTION PROTRACTOR

BACKGROUND OF THE INVENTION

1. Field of the Invention

The present invention relates to a protractor, and more particularly to a students multi-function protractor.

2. Description of the Prior Art

The closest prior art of which one of the applicants is aware is his prior U.S. Pat. No. 4,791,733 to Pan and Tseng.

The present invention has arisen to provide a novel students multi-function protractor.

SUMMARY OF THE INVENTION

The primary objective of the present invention is to provide a novel students multi-function protractor which is provided for easily drawing different geometric figures.

In accordance with one aspect of the invention, there is provided a protractor including a base having a curved surface formed therein, a disc including a circular outer peripheral surface for slidable engagement with the curved surface of the base, the disc including an opening formed therein which includes a pair of flanges formed in parallel therein, and a slide including an upper surface having a rib longitudinally formed in a middle portion thereof and including two end portions slidably engaged with the flanges of the disc respectively so that the slide can be guided to slide along the flanges, whereby various geometric figures can be drawn when the disc rotates relative to the base and when the slide slides along the flanges.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
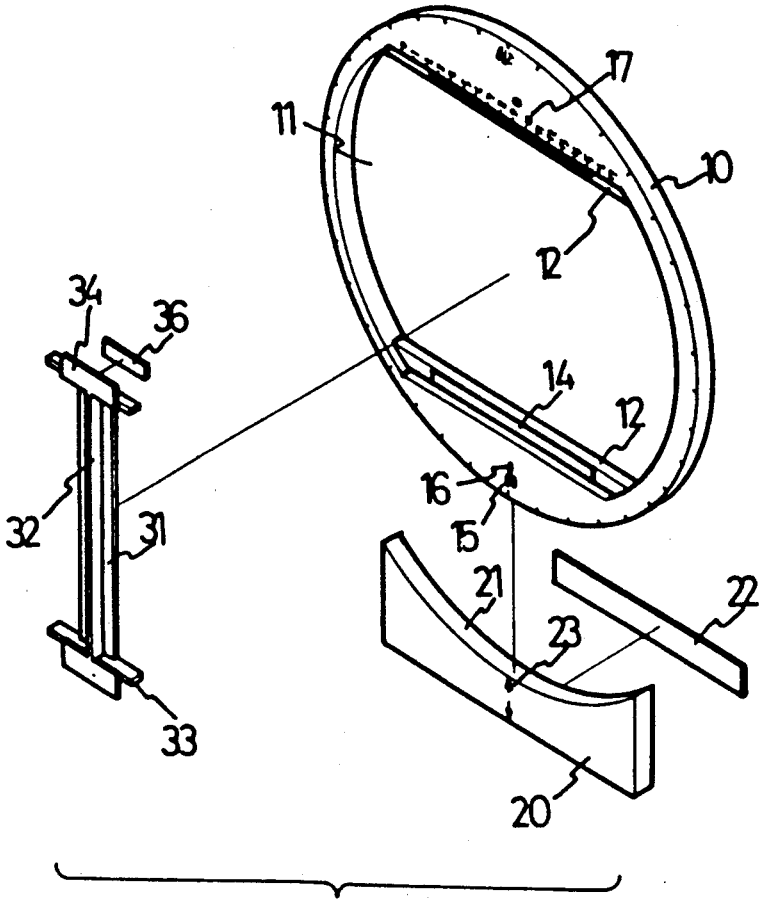
FIG. 1 is an exploded view of a students multi-function protractor in accordance with the present invention.
Figure 2:
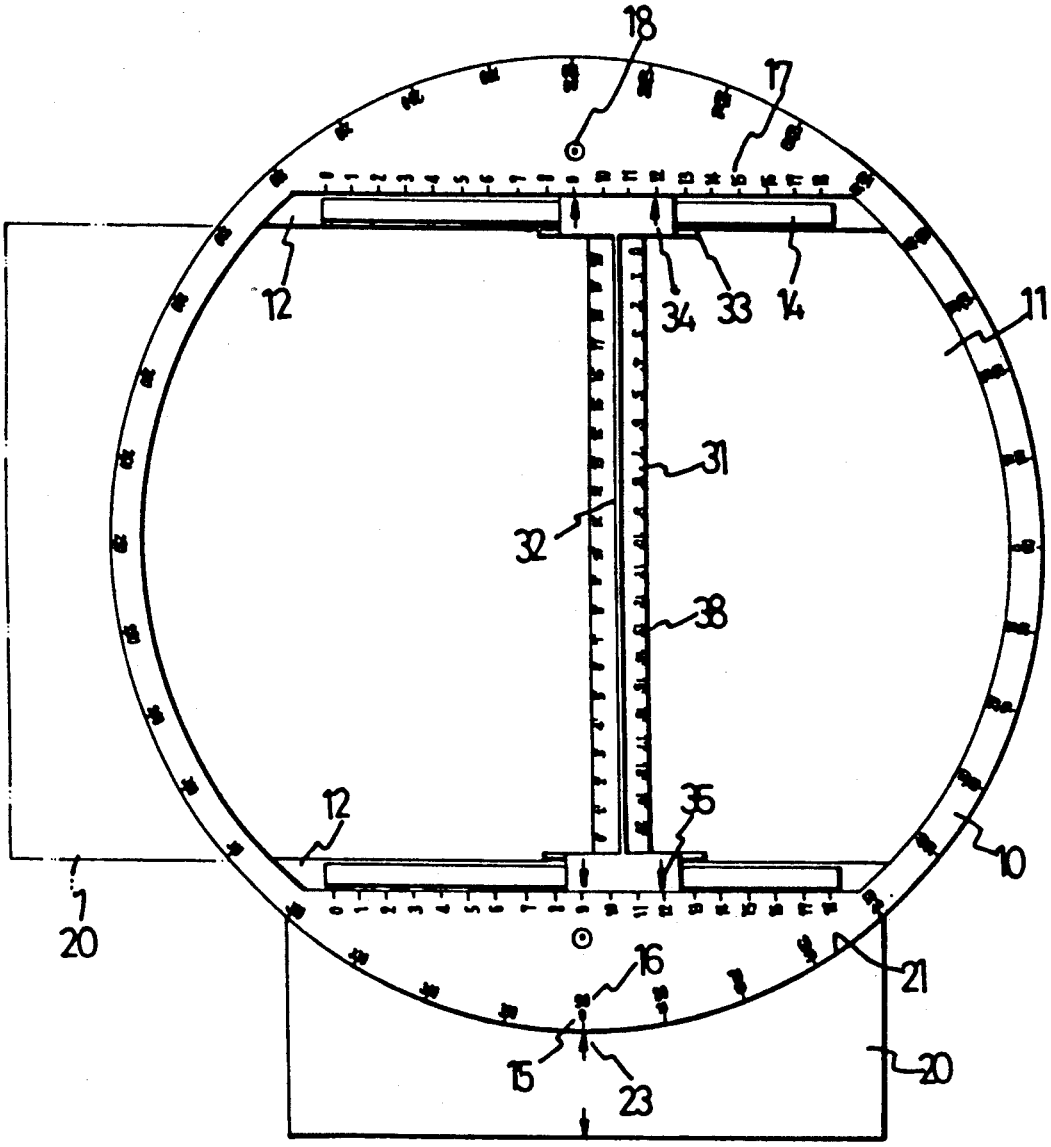
FIG. 2 is a top plane view of the students multi-function protractor.

Referring to the drawings, and initially to FIGS. 1 and 2, a students multi-function protractor in accordance with the present invention comprises generally a disc 10 having a circular outer peripheral surface and a base 20 having a curved surface 21 formed in an upper portion for slidable engagement with the circular outer peripheral surface of the disc 10. It is preferable that a magnet or a metal strip 22 is fixed on the bottom of the base 20 so that the base 20 can be attracted by the magnet embedded in the conventional drafting table and so that the base 20 can be stably disposed on the conventional drafting table. An arrow 23 is provided on the middle portion of the upper surface of the base 20 and is used as a reference point.

The disc 10 includes an opening 11 formed therein which includes a pair of parallel flanges 12 formed in the lower portion and in the upper portion thereof respectively. A metal strip 14 is disposed upon each of the flanges 12. A first angular scale 15 and a second angular scale 16 are provided on the perimeter of the upper surface of the disc 10. A linear scale 17 is provided beside each of the flanges 12. A mark 18 is provided beside each of the linear scale 17 for indicating the middle point of each of the flanges 12.

A slide 31 includes a rib 32 longitudinally formed on the middle portion of the upper surface thereof so that the slide 31 can be easily moved, and an end plate 33 and an extension 34 formed on each end thereof. The end plate 33 and the extension 34 form an L-shaped portion for slidable engagement with a respective flange 12 so that the slide 31 can be guided to slide along the flanges 12. Two arrows 35 are provided on the upper surface of each of the extensions 34. A magnet 36 is disposed on the bottom of each of the extensions 34 for attracting the metal strips 14 of the flanges 12 so that the slide 31 can be maintained in place relative to the disc 10. A linear scale 38 is provided on each side of the slide 31.

It is to be noted that, as shown in FIG. 2, a distance is formed between the side edge of the slide 31 and the closest arrow 35 and is preferably equal to 0.25 mm which equals to half of the diameter of the typical lead of the pencil, such that a line with reference to the scale indicated by the arrow 35 can be drawn. As shown in dotted lines in the left side of the disc 10, the base 20 can be moved along the periphery of the disc 10 to any desired place. The first angular scale 15 of the disc 10 indicates the rotational angle of the disc 10 relative to the base 20, and the second angular scale 16 indicates the angular position of the slide 31 relative to the base 20; for example, as shown in FIG. 2, the numeral "0" of the first angular scale 15 indicates that the disc 10 does not rotate relative to the base 20, and the numeral "90" of the second angular scale 16 indicates that the slide 31 has a 90-degree included angle with the base 20.

Figure 3:
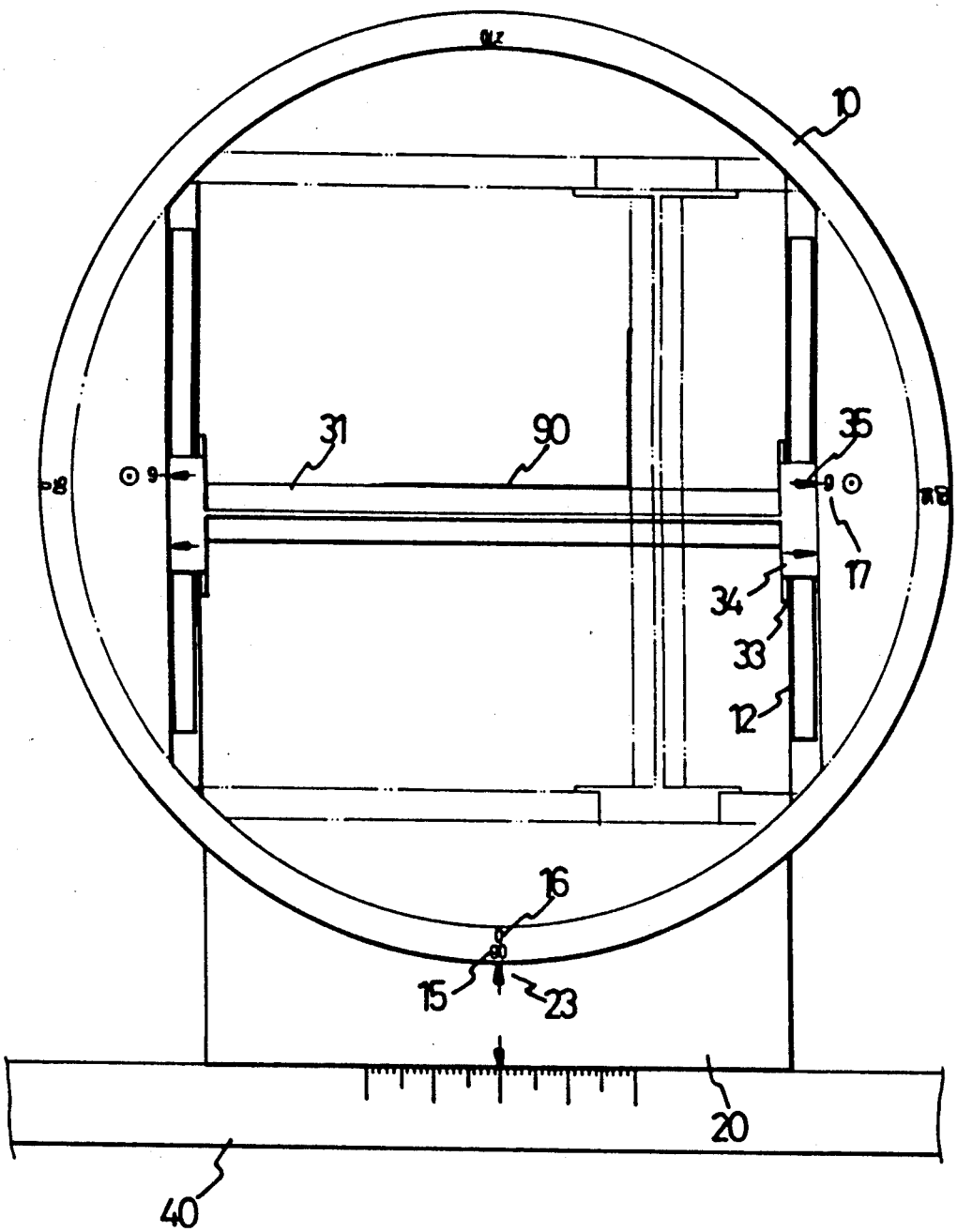
FIGS. 3, 4, 5 and 6 are top plane views illustrating the operations of the students multi-function protractor.

As shown in FIG. 3, a metal scale 40 can be further disposed below the base 20 and can be attracted by the drafting table so that the base 20 can further be retained in place. When the first angular scale 15 indicates "90", the disc 10 is rotated 90 degrees relative to the base 20, and when the second angular scale 16 indicates "0", the slide 31 is positioned in a horizontal position, such that two lines 90 which are perpendicular with each other can be easily drawn.

Figure 4:
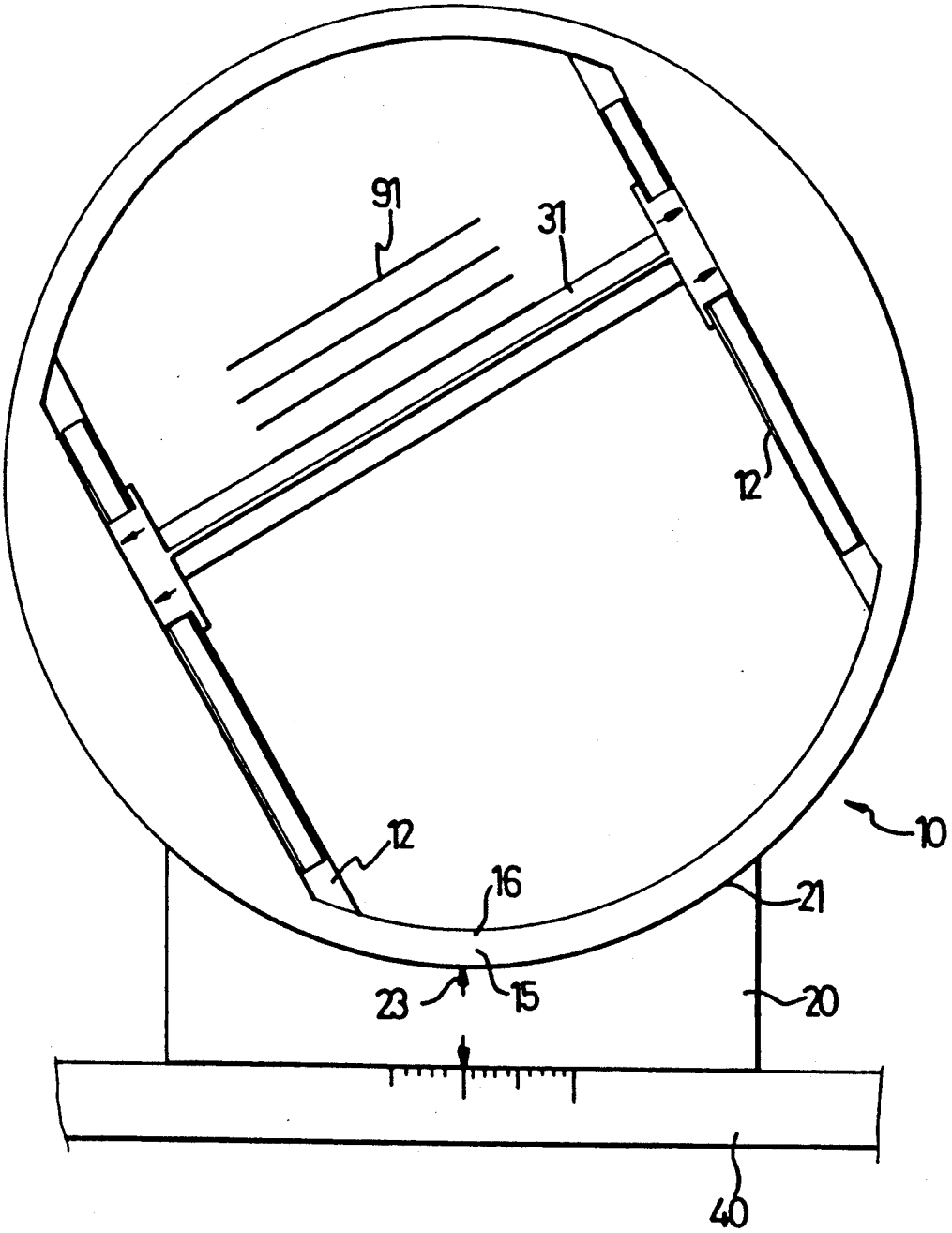

As shown in FIG. 4, when the disc 10 is rotated for 60 degrees relative to the base 20, the slide 31 is disposed with an included angle relative to the base 20 so that the lines 91 which have an included angle with respect to the base 20 can be easily drawn.

Figure 5:
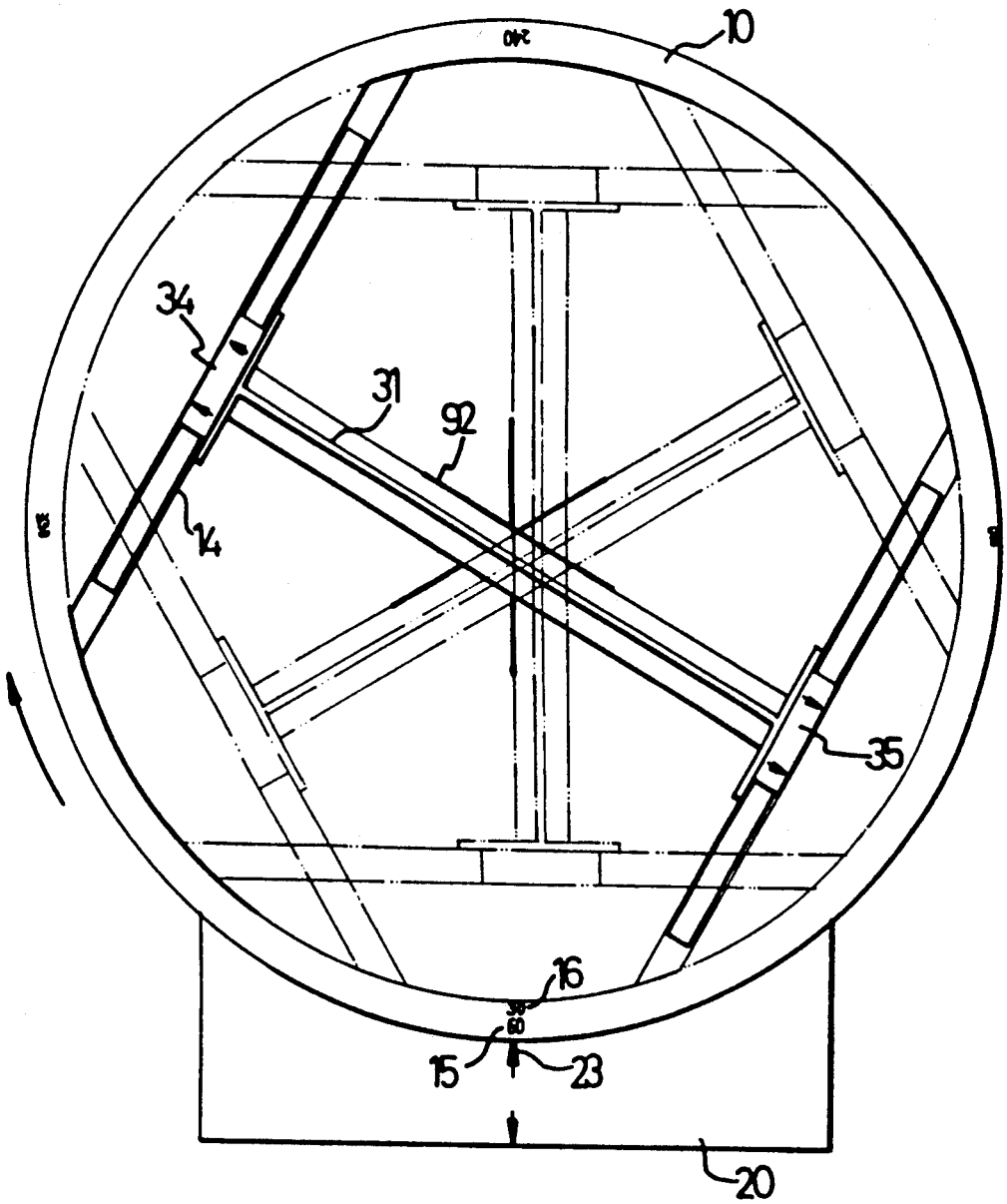

Referring next to FIG. 5, when the disc 10 is rotated with 30 degrees relative to the base 20 twice, three lines 92 which intersect at one point can be drawn so that the plane on which the disc 10 is disposed can be equally sectioned and divided.

Figure 6:
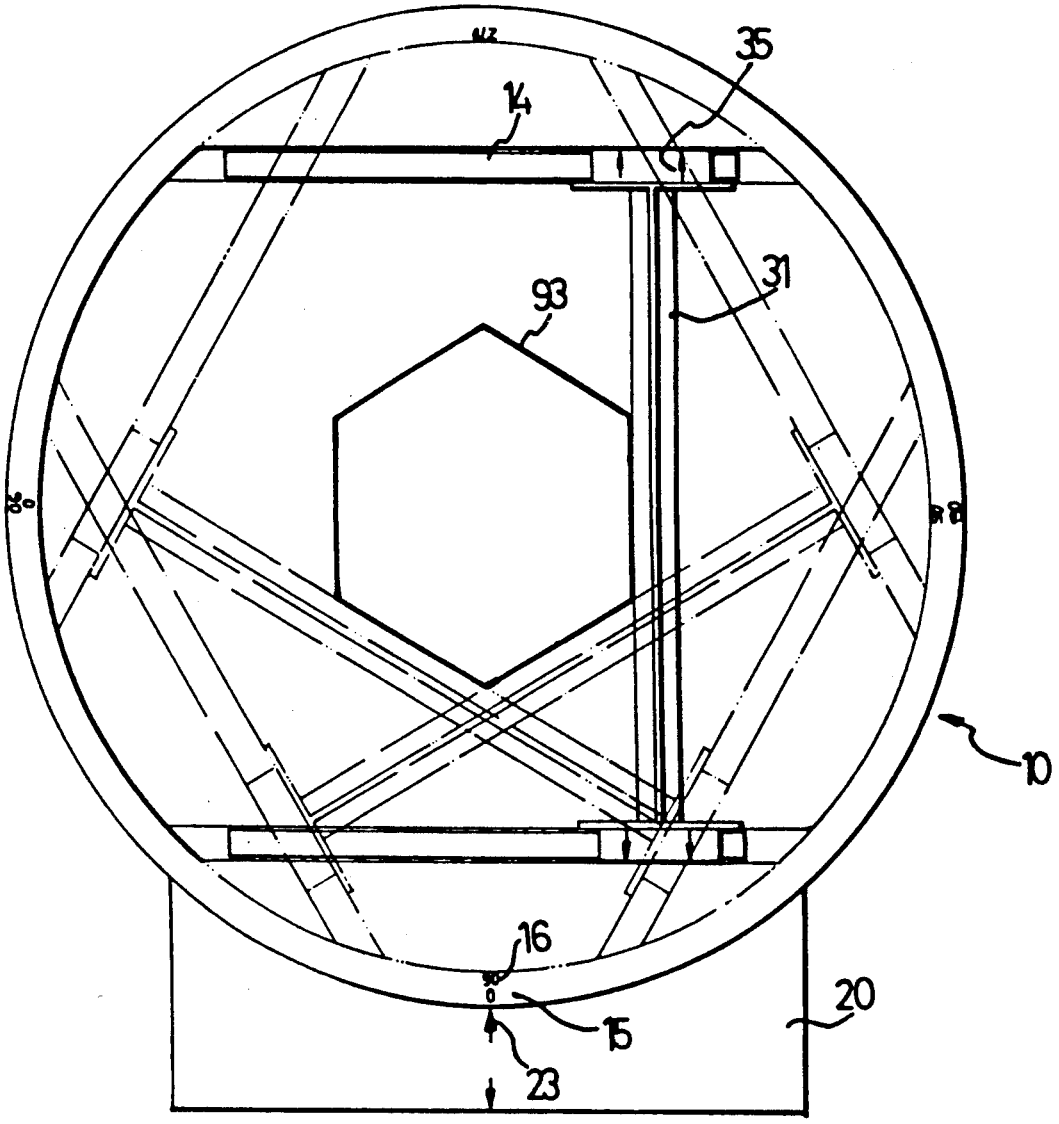

Referring next to FIG. 6, a hexagon 93 can be easily drawn by the instrument in accordance with the present invention.

Accordingly, various kinds of geometric figures can be easily drawn by the students multi-function protractor in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A protractor comprising a base having a curved surface formed therein, a disc including a circular outer peripheral surface for slidable engagement with said curved surface of said base, said disc including an opening formed therein which includes a pair of flanges formed in parallel therein, and a slide including an upper surface having a rib longitudinally formed in a middle portion thereof and including two end portions slidably engaged with said flanges of said disc respectively so that said slide is guided to slid along said flanges, each of said end portions of said slide including an end plate and an extension forming a ninety degree included angle with each other for slidable engagement with said flanges of said disc, a metal strip disposed on an upper surface of each of said flanges, and a magnet disposed on a bottom of each of said extensions of said slide for attracting said metal strip of said flanges so that said slide is retained in place relative to said disc, whereby various geometric figures can be drawn when said disc rotates relative to said base and when said slide slides along said flanges.

2. A protractor according to claim 1, wherein a linear scale is disposed beside each of said flanges, a mark is disposed on a middle portion of said linear scale, said slide includes two side edges, two arrows are provided on an upper surface of each of said extensions and each of said arrows has a distance spaced from a closer side edge of said slide.

3. A protractor comprising a base having a curved surface formed therein, a disc including a circular outer peripheral surface for slidable engagement with said curved surface of said base, said disc including an opening formed therein which includes a pair of flanges formed in parallel therein, a slide including an upper surface having a rib longitudinally formed in a middle portion thereof and including two end portions each having an end plate and an extension, said end plate and said extension being perpendicular with each other so as to form a ninety degree included angle with each other for slidable engagement with said flanges of said disc so that said slide can be guided to slide along said flanges, a metal strip disposed on an upper surface of each of said flanges, and a magnet disposed on a bottom of each of said extensions of said slide for attracting said metal strip of said flanges so that said slide can be retained in place relative to said disc, whereby various geometric figures can be drawn when said disc rotates relative to said base and when said slide slides along said flanges.

* * * * *

UNITED STATES PATENT AND TRADEMARK OFFICE

CERTIFICATE OF CORRECTION

PATENT NO. : 5,187,873

DATED : February 23, 1993

INVENTOR(S) : Bill C. B. JENG, et al.

It is certified that error appears in the above-identified patent and that said Letters Patent is hereby corrected as shown below:

Column 1, line 11, delete the word "his".

Column 2, line 5, change the word "scale" to read --scales--.

IN THE CLAIMS:

Column 3, line 13 (Claim 1, line 10), change "slid" to read the word --slide--.

Signed and Sealed this

Sixteenth Day of November, 1993

*Attest:*

*Attesting Officer*

BRUCE LEHMAN

*Commissioner of Patents and Trademarks*